US008459769B2

(12) United States Patent
Xu et al.

(10) Patent No.: US 8,459,769 B2
(45) Date of Patent: Jun. 11, 2013

(54) GRAYSCALE PRINTING CONTROL METHOD AND DEVICE

(75) Inventors: Zhigang Xu, Shandong (CN); Qiangzi Cong, Shandong (CN); Chuntao Wang, Shandong (CN); Lei Che, Shandong (CN); Jiabo Xu, Shandong (CN)

(73) Assignee: Shandong New Beiyang Information Technology Co., Ltd, Weihai, Shandong (CN)

( * ) Notice: Subject to any disclaimer, the term of this patent is extended or adjusted under 35 U.S.C. 154(b) by 442 days.

(21) Appl. No.: 12/934,952

(22) PCT Filed: Dec. 11, 2008

(86) PCT No.: PCT/CN2008/073450

§ 371 (c)(1), (2), (4) Date: Sep. 27, 2010

(87) PCT Pub. No.: WO2009/121236

PCT Pub. Date: Oct. 8, 2009

(65) Prior Publication Data

US 2011/0043861 A1 Feb. 24, 2011

(30) Foreign Application Priority Data

Mar. 31, 2008 (CN) ..... 2008 1 0090417

(51) Int. Cl.
*B41J 2/205* (2006.01)

(52) U.S. Cl.
USPC ..... 347/15; 347/185; 347/188

(58) Field of Classification Search
USPC ..... 347/14, 15, 43, 60, 185, 188
See application file for complete search history.

(56) References Cited

U.S. PATENT DOCUMENTS

| | | | | |
|---|---|---|---|---|
| 4,760,462 | A | 7/1988 | Ogawa | |
| 5,455,681 | A * | 10/1995 | Ng | 358/3.01 |
| 6,798,433 | B1 | 9/2004 | Sun et al. | |
| 7,391,427 | B2 * | 6/2008 | LeBlanc | 347/188 |

FOREIGN PATENT DOCUMENTS

| | | | |
|---|---|---|---|
| CN | 1118308 | A | 3/1996 |
| CN | 1403295 | A | 3/2003 |
| CN | 1579790 | A | 2/2005 |
| JP | 1-128837 | A | 5/1989 |
| JP | 7-108700 | A | 4/1995 |
| JP | 2006-347034 | A | 12/2006 |

OTHER PUBLICATIONS

International Search Report dated Mar. 26, 2009 (with English Translation), 6 pages.

* cited by examiner

*Primary Examiner* — Thinh Nguyen
(74) *Attorney, Agent, or Firm* — Harrity & Harrity, LLP

(57) ABSTRACT

A grayscale printing control method, a device thereof and a storage medium are provided. The method comprises: determining the grayscale level of image data of each point in each point line and converting the same into multi-bit binary data; forming a data set using the binary data of the same bit of all the points in a point line, thereby forming multiple data sets; each data set corresponding to a predetermined strobe time, and the print head heater corresponding to each point heating upon receiving predetermined data during the strobe time. The present invention can reduce the number of printing strobes and the times of data transmission while ensuring printing quality, thereby greatly improving printing speed.

12 Claims, 9 Drawing Sheets

GRAYSCALE PRINTING CONTROL METHOD AND DEVICE

The present application claims the priority of the Chinese patent application No. 200810090417.6 filed with the Chinese Patent Office on Mar. 31, 2008 and entitled "Grayscale Printing Control Method and Device", and all the contents thereof are incorporated by reference into the present application.

FIELD OF THE INVENTION

The present invention relates to field of printing control technology, and more particularly, to a grayscale printing control method and device for a thermal print head.

BACKGROUND ART

Heat printers are divided into two types: a thermal printer and a thermal transfer printer. Wherein, the thermal printer generates heat using a print head heater, so as to cause chemical changes of a thermo-sensitive layer on the surface of a printing paper, and thus develop color to form text and images. The thermal transfer printer generates heat using a print head heater to heat the dye on an ink ribbon which is then melted on the surface of a printing paper to form text or images.

FIG. 1 is a schematic view of the arrangement of the printing points of a thermal print head, and as shown therein the thermal print head 10 comprises multiple heaters 20 arranged in a line with an equal distance therebetween, and each heater corresponds to one printing point X1, thereby forming a point line. A print medium 30 moves in the printing direction A, thereby forming point lines such as Y1 and Y2.

The longer the heating time of the print head heater is, the more the heat is and then the higher the printing density is. Therefore, the printing effect of different density levels, i.e., grayscale levels, is obtained by controlling the length of the heating time. Referring to FIG. 2 and FIG. 3, FIG. 2 illustrates a schematic view of a traditional grayscale printing control method; and FIG. 3 is a schematic view of the constitution of the strobe time of the grayscale levels in the method.

This method specifically includes the following steps:

Step S11, the heating time (tu) of a reference grayscale is set;

Step S12, when the print head heater receives data of 1, the heater heats, and when receives data of 0, the heater does not heat.

Step S13, n (n=1, 2, 3 . . . ) pulses are continuously transmitted, and corresponding to each pulse n binary data "1" are transmitted to the heater.

It can be seen that since n pulses need to be continuously transmitted while performing multiple grayscale levels of printing using the above control method, the grayscale levels will not be in direct proportion to the times of printing due to the heat accumulation of the print head, thus resulting in grayscale distortion and then affecting the printing quality.

To solve this problem, a US patent (U.S. Pat. No. 6,798,433), entitled "Method for Increasing Thermal Print Quality", discloses a control method, and as shown in FIG. 4 and FIG. 5, FIG. 4 is a flow chart of the control method, and FIG. 5 is a schematic view of the constitution of the strobe time of the grayscale levels in the control method.

The control method specifically includes the following steps:

Step S21, the heating time (tu) of a reference grayscale is set;

Step S22, when the print head heater receives data of 1, the heater heats, and when receives data of 0, the heater does not heat.

Step S23, n pulses are transmitted, a time is set for each pulse interval, and corresponding to each pulse n binary data "1" are transmitted to the heater.

It can be seen that the above method reserves enough heat dissipation time for the print head by setting the interval between the transmission of every two pulses, and then avoids the problem in the printing effect of the distortion due to heat accumulation. However, this method also has some defects: relatively slow printing speed, especially for a relatively high grayscale level of printing, the printing speed is affected since a relatively large number of pulses need to be transmitted and the data transmission takes a relatively long time.

SUMMARY OF THE INVENTION

With this respect, the present invention provides a grayscale printing control method and device to solve the problem in the prior art that the printing speed is affected due to the long data transmission time.

The present invention is realized in the following way.

A grayscale printing control method includes:

determining the grayscale level of image data of each point in each point line and converting the same into multi-bit binary data;

forming a data set using the binary data of the same bit of all the points in a point line, thereby forming multiple data sets; and each data set corresponding to a predetermined strobe time, and the print head heater corresponding to each point heating upon receiving predetermined data during the strobe time.

Preferably, the predetermination of the strobe time is realized in the following manner:

setting multiple reference grayscale levels each of which corresponds to a strobe time with a set duration;

in a printing period of one point line, setting the number of strobes which is the same as the number of the reference grayscale levels, the duration of each strobe corresponding to the strobe time needed by one reference grayscale level.

Preferably, the method further comprises:

transmitting a preheat signal to the print head heater to instruct the print head heater to preheat before printing.

Preferably, there are $2^n$ grayscale levels in total, and the number of the reference grayscale levels is set to be n, and the number of the predetermined strobes is n.

Preferably, the predetermined data is 1 or 0.

The present invention also discloses a grayscale printing control device, comprising:

a first processing unit, configured to convert the grayscale level of grayscale image data of each point in each point line into multi-bit binary data; a second processing unit, configured to form a data set using the binary data of the same bit of all the points in a point line, thereby forming multiple data sets; an information reference unit which stores the corresponding relationship between the data sets and strobe time; and a transmitting unit which refers to the corresponding relationship and transmits the data sets to a print head within a corresponding strobe time, so that during the strobe time the print head heater corresponding to respective points heats upon receiving predetermined data.

Preferably, the above device further comprises:

a third processing unit configured to transmit a preheat signal to the print head heater to instruct the print head heater to preheat before printing.

Preferably, in the above device, the grayscale levels include multiple reference grayscale levels which correspond to the strobe periods of the strobes in the printing period of a point line.

Preferably, in the above device, there are $2^n$ grayscale levels in total, and the number of the reference grayscale levels is set to be n, and the number of the strobes in the printing period of the point line is n.

preferably, in the above device, the predetermined data is 1 or 0.

The present invention also discloses a computer-readable storage medium including a computer program code executed by a computer unit, so that the computer unit:

determining the grayscale level of image data of each point in each point line and converting the same into multi-bit binary data;

form a data set using the binary data of the same bit of all the points in a point line, thereby forming multiple data sets; and each data set corresponds to a predetermined strobe time, and the print head heater corresponding to the point heats upon receiving predetermined data during the strobe time.

As can be seen from the above technical solution, compared with the prior art, for the printing of a $2^n$ level of grayscale, the present invention just needs to set n strobes for the print head and transmit data n times, and realizes the printing of a $2^n$ level of grayscale by combining n segments of strobe time of different levels. The present invention can reduce the number of printing strobes and the times of data transmission while ensuring printing quality, thereby greatly improving printing speed.

BRIEF DESCRIPTION OF ACCOMPANYING DRAWINGS

To more clearly describe the embodiments of the present invention or the technical solution in the prior art, the accompanying drawings used in describing the embodiments or the prior art will be briefly described hereinafter, and obviously, the accompanying drawings described hereinafter are just some embodiments of the present invention, and for one skilled in the art, other accompanying drawings may be obtained according to such accompanying drawings without ingenuity work.

DETAILED DESCRIPTION OF THE INVENTION

Grayscale refers to the shade of color, and the higher a grayscale level is, the deeper a color is, and the more the grayscale levels are, the more the changes of the shade of an image as represented are and then the more exquisite and the more vivid the printed image is.

To enable one skilled in the art to better understand the technical solutions of the embodiments of the present invention, detailed description is made hereinafter in conjunction with the accompanying drawings and the embodiments.

Figure 1:
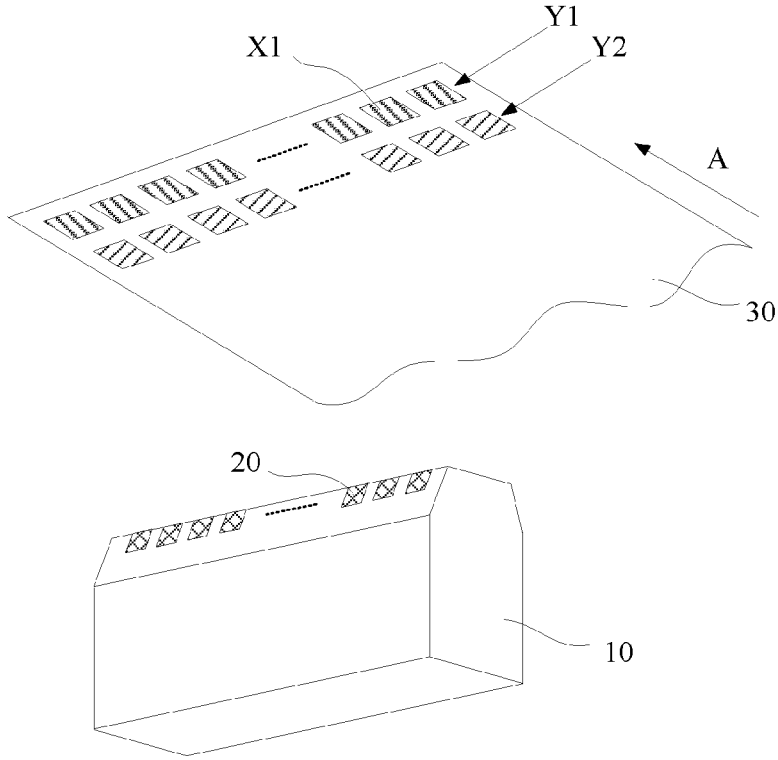
FIG. 1 is a schematic view of the arrangement of the printing points of a thermal print head.
Figure 2:
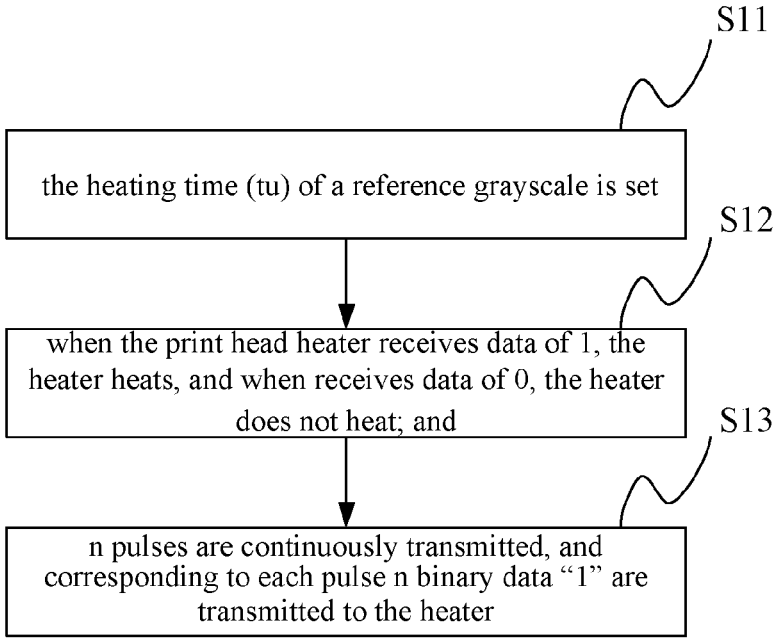
FIG. 2 is a schematic view of a traditional grayscale printing control method.
Figure 3:
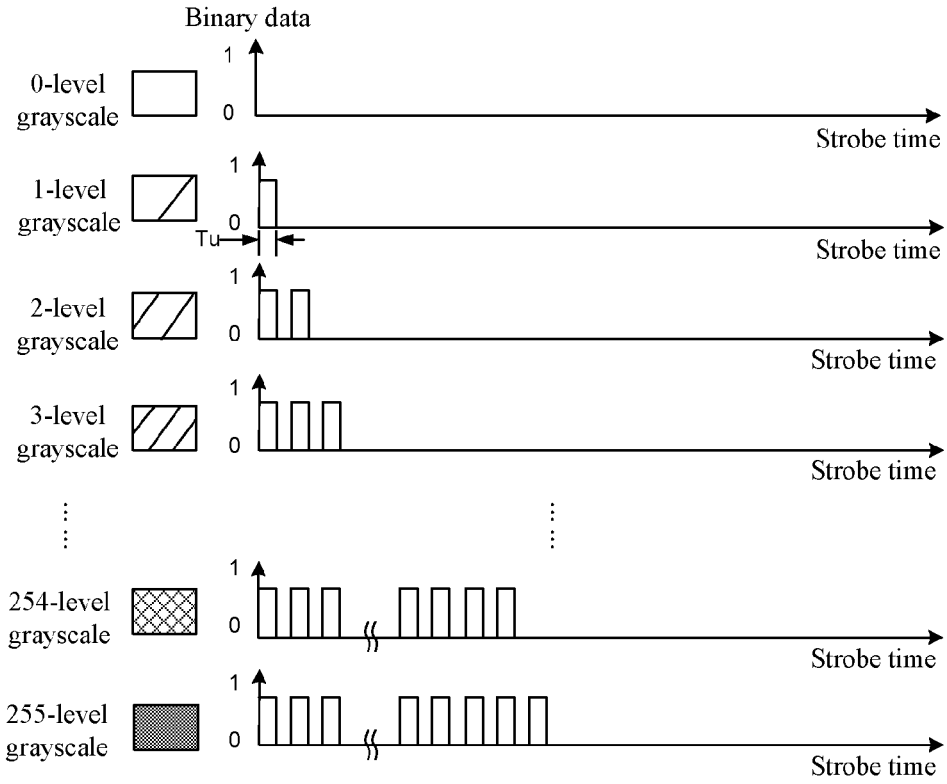
FIG. 3 is a schematic view of the constitution of the strobe time of the grayscale levels in the method shown in FIG. 2.
Figure 4:
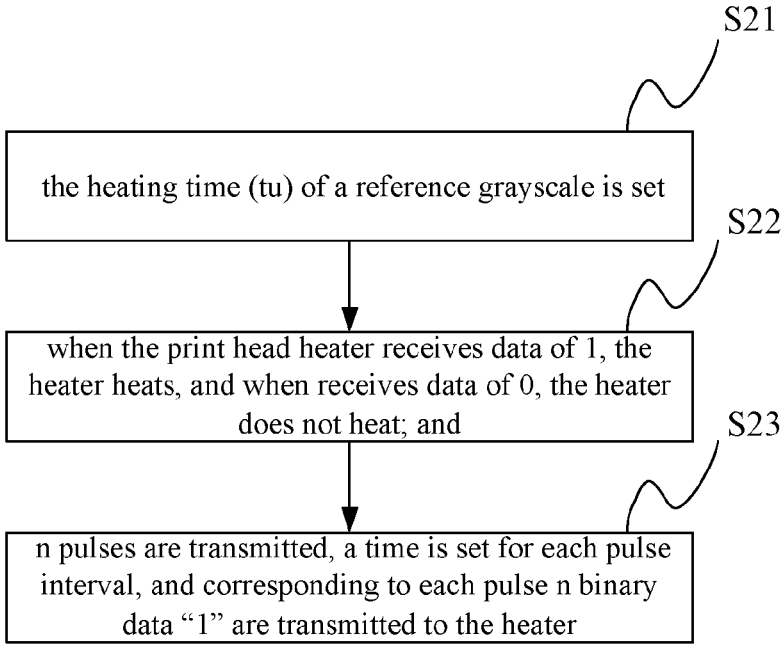
FIG. 4 is a flow chart of realizing a control method in the prior art.
Figure 5:
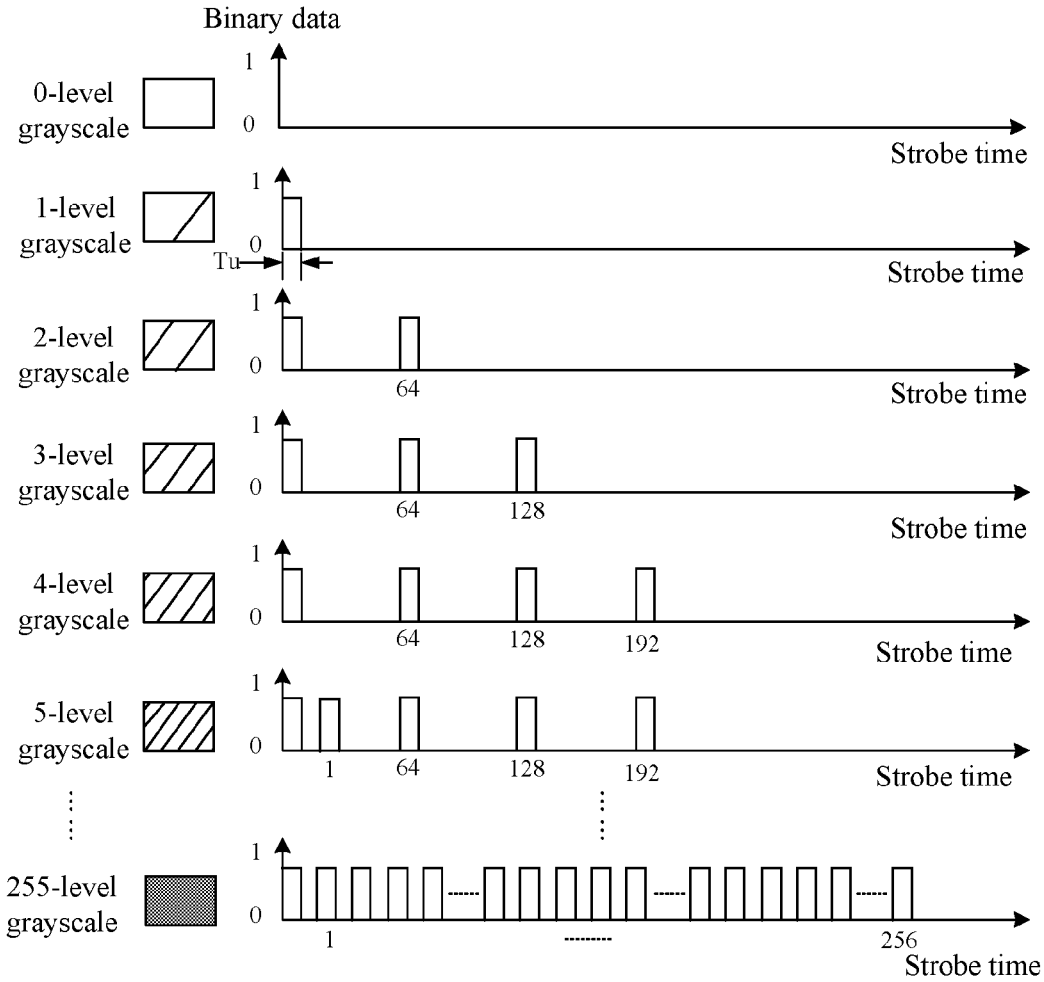
FIG. 5 is a schematic view of the constitution of the strobe time of the grayscale levels in the control method shown in FIG. 4.
Figure 6:
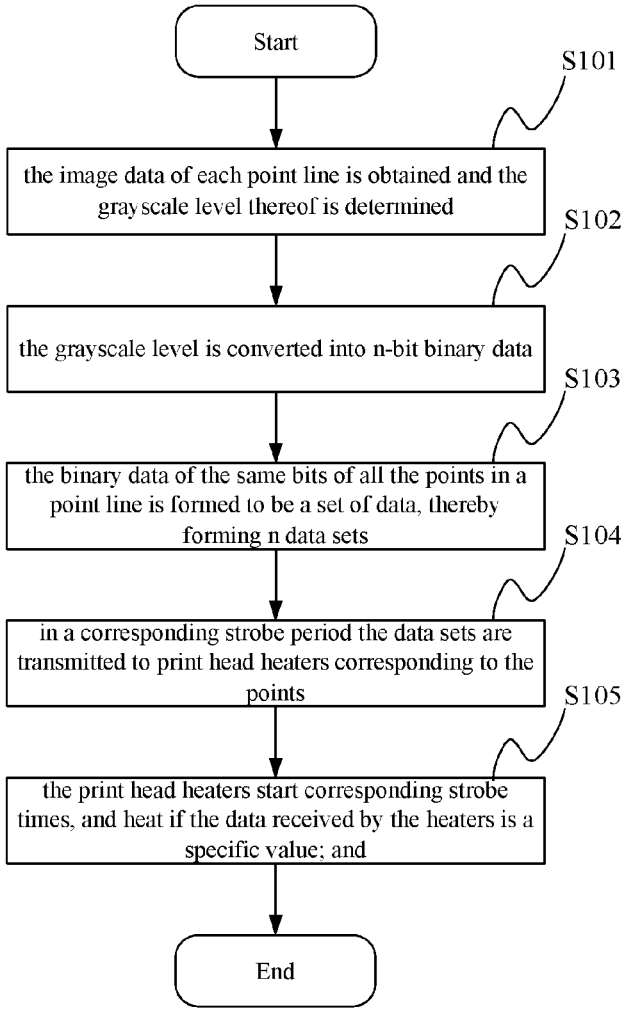
FIG. 6 is a flow chart of an embodiment of a grayscale printing control method according to the present invention.

Referring to FIG. 6, it is a flow chart of an embodiment of a grayscale printing control method according to the present invention.

Corresponding to various grayscale levels, a strobe period is set in advance in a printing period of a point line, and the grayscale levels are divided into reference grayscale levels and non-reference grayscale levels, and the strobe times corresponding to the non-reference grayscale levels are rendered by combining the strobe times corresponding to the reference grayscale levels.

Assume there are $2^n$ levels of the grayscale levels, wherein the $2^0, 2^1, 2^2, \ldots, 2^{n-1}$ levels are reference grayscale levels, and the other grayscale levels are non-reference grayscale levels. The non-reference grayscale levels can be obtained by superposing and combining reference grayscale levels, for example, when n=8, 1, 2, 4, 8, 16, 32, 64, 128 are reference grayscale levels, while the other grayscale levels such as 3, 5, 6, 7, . . . are non-reference grayscale levels, then the grayscale of level 3 is equal to the sum of the grayscale of level 1 and the grayscale of level 2, the grayscale of level 5 is equal to the sum of the grayscale of level 1 and the grayscale of level 4, . . . , and the rest can be deduced in the same manner. Corresponding to the reference grayscale levels, n reference strobe periods are set in the printing period of a point line, and recorded as: $T2^0$, $T2^1$, $T2^2$, . . . , $T2^{n-1}$, and the strobe periods corresponding to the non-reference grayscale levels can be rendered by combining the reference strobe periods.

Various grayscale levels of printing are controlled by the following steps:

Step S101, the image data of each point line is obtained and the grayscale level thereof is determined;

Step S102, the grayscale level is converted into n-bit binary data;

Step S103, the binary data of the same bits of all the points in a point line is formed to be a set of data, thereby forming n data sets;

Step S104, in a corresponding strobe period, the data sets are transmitted to print head heaters corresponding to the points; and Step S105, the print head heaters start corresponding strobe times, and heat if the data received by the heaters is a specific value.

After receiving the data, the print head heaters start corresponding strobe time, and in an effective strobe period, if the data received by the heaters is a specific value (for example, 1 or 0), they heat, otherwise, do not heat.

Thus, respectively corresponding to $T2^n$, the print head heaters are controlled to heat in corresponding strobe periods by transmitting n sets of data, so that a point image of different grayscale levels are printed according to the grayscale image data within a range of a point line where the print head is in close contact with consumables.

Figure 7:
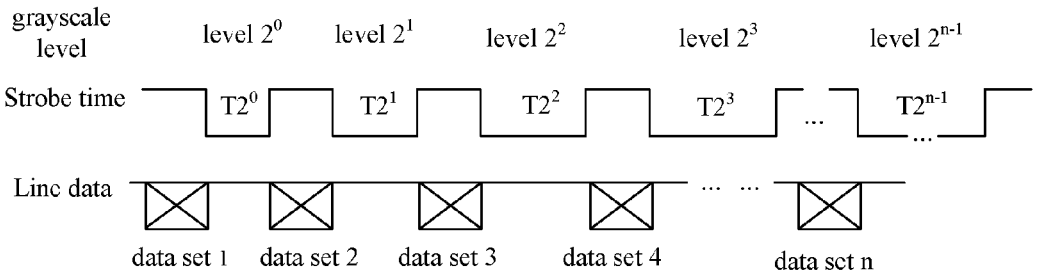
FIG. 7 illustrates the corresponding relationship between the grayscale level, the strobe time and data sets in the embodiment of a grayscale printing control method according to the present invention.

FIG. 7 illustrates the corresponding relationship between the grayscale level, the strobe time and data sets in the embodiment.

The grayscale levels $2^n$, $T2^n$ and the data set n correspond to each one by one, for example, after receiving the data set 1, the print head heater heats in the strobe period $T2^n$.

Figure 8:
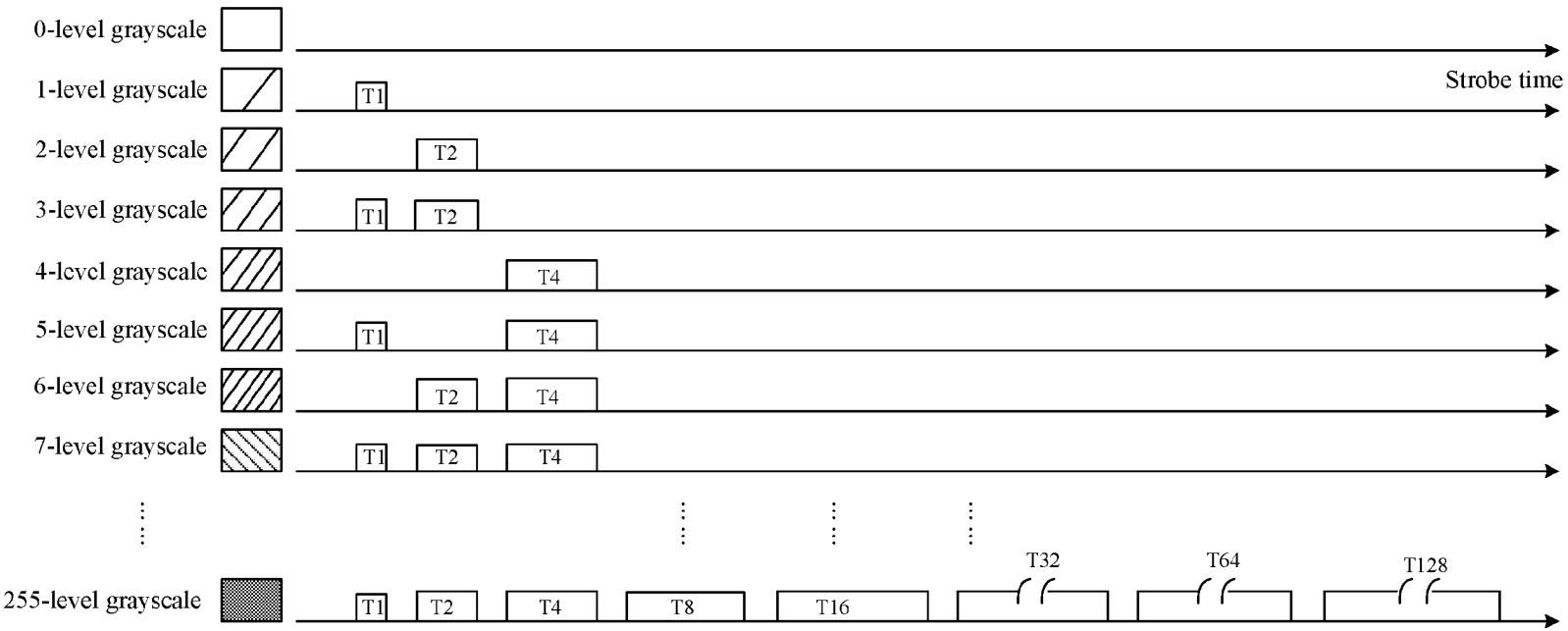
FIG. 8 is a schematic view of the constitution of the strobe time of the grayscale levels when n=8 in the embodiment of a grayscale printing control method according to the present invention.

When n=8, the schematic view of the constitution of the strobe time of the grayscale levels is shown in FIG. 8.

As shown in the Figure, when n=8, the highest grayscale level is equal to level 256.

Here, the strobe time of the grayscale of level 1 is T1, the strobe time of the grayscale of level 2 is T2, the strobe time of the grayscale of level 4 is T4, the strobe time of the grayscale of level 8 is T8, the strobe time of the grayscale of level 16 is T16, the strobe time of the grayscale of level 32 is T32, the strobe time of the grayscale of level 64 is T64, and the strobe time of the grayscale of level 128 is T128.

The eight strobe times are taken as reference strobe times, and among the 0-255 grayscale levels, the strobe time of the other grayscale levels can be constituted by combining these reference strobe times. For example, the strobe time of the grayscale of level 3 can be obtained by the combination of T1+T2, the strobe time of the grayscale of level 5 can be obtained by the combination of T2+T3, the strobe time of the grayscale of level 6 can be obtained by the combination of T2+T4, . . . , the strobe time of the grayscale of level 252 can be obtained by the combination of T128+T64+T32+T16+T8+T4, . . . , and the rest can be deduced in the same manner, and 256 grayscale level strobe times can be selected.

It needs to be indicated that the lengths of the strobe times of the grayscale levels need to be measured and verified by experiments in advance.

Figure 9:
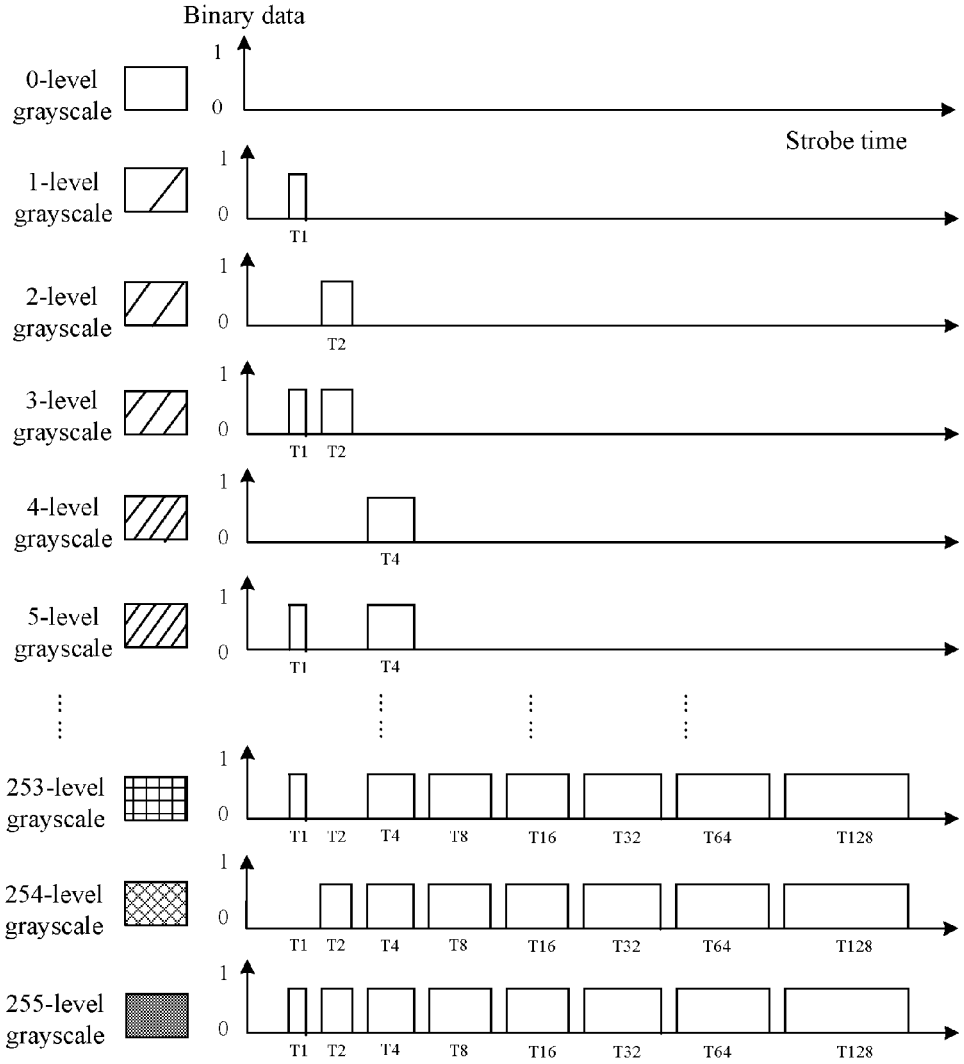
FIG. 9 illustrates the corresponding relationship between the strobe time and the binary data of the points of various grayscale levels when n=8 in the embodiment of a grayscale printing control method according to the present invention.

The print head heaters only heat within corresponding strobe time to print corresponding grayscale levels, and how the print head heaters heat within specific strobe periods so as to print the grayscale levels will be described hereinafter in conjunction with FIG. 9. FIG. 9 illustrates the corresponding relationship between the strobe time and the binary data of the points of various grayscale levels when n=8.

The print head heaters will heat within corresponding strobe periods upon receiving specific binary data. The specific binary data can be 1, that is to say, the print head heaters will heat when the binary data as received is 1, while will not heat when the binary data received is 0. Certainly the specific binary data can also be 0, that is to say, the print head heaters will heat when the binary data as received is 0, while will not heat when the binary data received is 1. The present invention only makes description taking the specific binary data 1 as an example.

For the grayscale of level 0, within the eight strobe periods of one printing period, the binary data corresponding to all the strobe periods is 0, and then the print head heaters do not heat after receiving the binary data and the printing points develop the primary color of a printing paper. For the grayscale of level 1, within the eight strobe periods of one printing period, the binary data of the strobe period T1 corresponding to the data received by the print head heaters is 1, and all the binary data of the other strobe periods corresponding to the same is 0, and thus the print head heaters only heat within the strobe period T1 and will not heat in the other strobe periods, and the printing points display the grayscale of level 1. For the grayscale of level 2, within the eight strobe periods of one printing period, the binary data of the strobe period T2 corresponding to the data received by the print head heaters is 1, and the binary data of the other strobe periods corresponding to the same is 0, and thus the print head heaters only heat within the strobe period T2 and will not heat in the other strobe periods, and the printing points display the grayscale of level 2. Likewise, for the grayscale of level 3, within the eight strobe periods of one printing period, the binary data of the strobe periods T1 and T2 corresponding to the data received by the print head heaters is 1, and the binary data of the other strobe periods corresponding to the same is 0, and thus the print head heaters only heat within the strobe periods T1 and T2 and will not heat in the other strobe periods, and the printing points display the grayscale of level 3 . . . . The rest is deduced in the same manner, and for the grayscale of level $2^8$, i.e., level 256, within the eight strobe periods of one printing period, the binary data of all the strobe periods corresponding to the data received by the print head heaters is 1, and thus the print head heaters heat within the eight strobe periods of one printing period, and the printing points display the grayscale of level 256.

Figure 10:
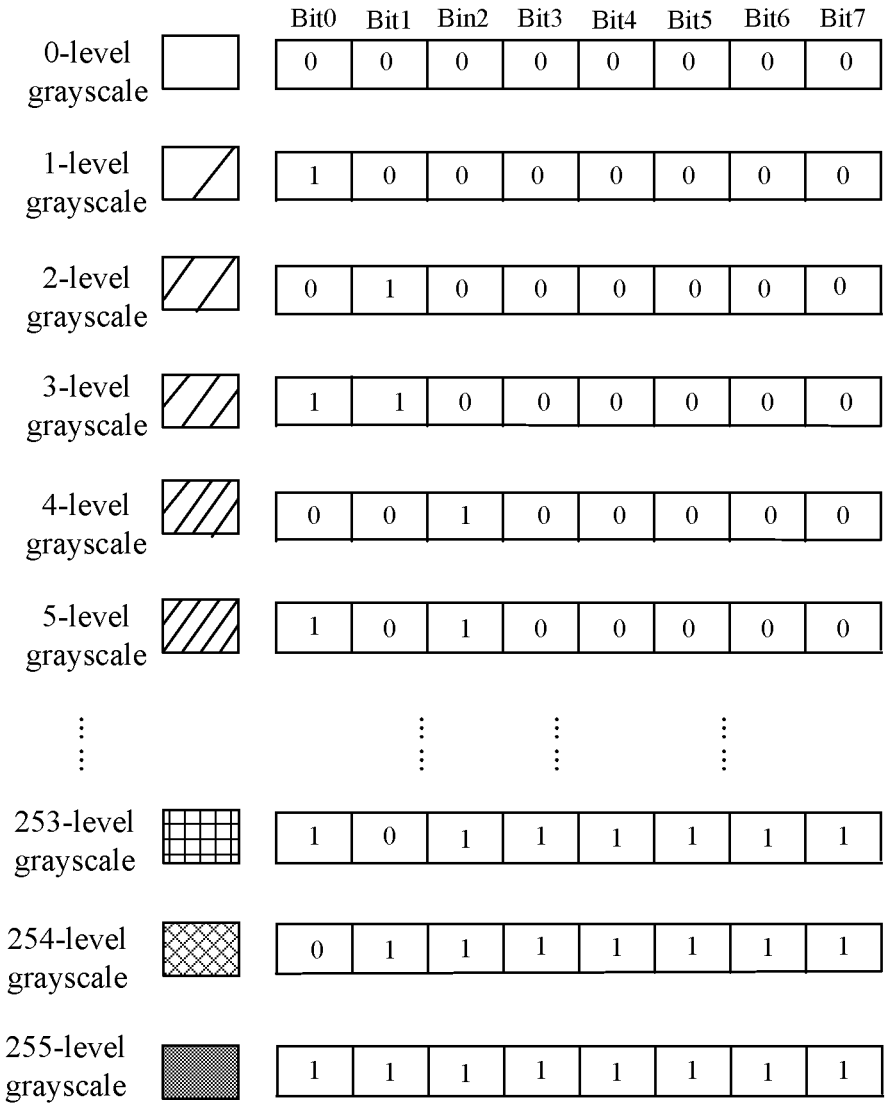
FIG. 10 is a schematic view of the 8-bit binary data of the points of various grayscale levels when n=8 in the present invention.

It can be rendered from the above description that for the printing of the grayscale of level 256, the 8-bit binary data of the grayscale levels can be induced. Referring to FIG. 10, it is a schematic view of the 8-bit binary data of the points of various grayscale levels when n=8.

It is known from the above description that the grayscale levels correspond to the eight strobe periods of the printing period and there exists 8-bit binary data. That is to say, each grayscale level can be represented by an 8-bit binary data.

As shown in the Figure, corresponding to the grayscale of level 1, its 8-bit binary data is 10000000, corresponding to the grayscale of level 2, its 8-bit binary data is 01000000, corresponding to the grayscale of level 3, its 8-bit binary data is 11000000, . . . , and corresponding to the grayscale of level 255, its 8-bit binary data is 11111111.

The binary data of the same bits of all the points in each point line is formed to a set of data, thereby forming n data sets. For example, the bits Bit0 of all the grayscale points in a point line are formed to be data set 1, the bits Bit1 of all the grayscale points in the point line are formed to be data set 2, and the rest is deduced in the same manner, all the bit Bit2, bits Bit3, bits Bit4, bit Bit5, bit Bit6 and bits Bit7 of all the grayscale points in the point line are respectively formed to be data set 3, data set 4, data set 5, data set 6, data set 7 and data set 8. Thus, in one printing period, data set 1 is transmitted to the print head heaters during the strobe period T1, data set 2 is transmitted to the print head heaters during the strobe period T2, data set 3 is transmitted to the print head heaters during the strobe period T3, . . . , the rest is deduced in the same manner, and data set 8 is transmitted to the print head heaters during the strobe period T128, and the printing of the grayscale of the 256 levels can be realized by transmitting the data set eight times.

Figure 11:
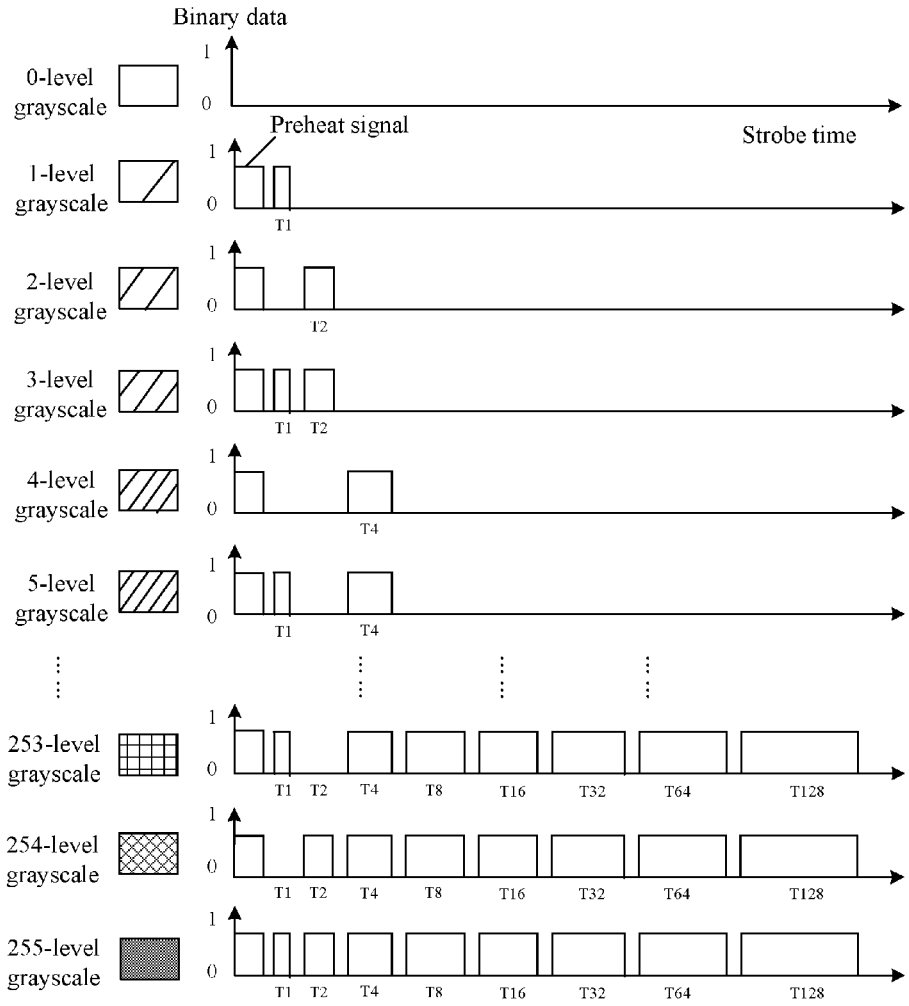
FIG. 11 illustrates the corresponding relationship between the strobe time and the binary data of the points of various grayscale levels when n=8 in the embodiment of a grayscale printing control method according to the present invention.

As the heating of the print head heaters takes a certain period, to further accelerate the printing speed, before transmitting to the data sets to the print head heaters, a preheat signal may be sent to all the print heat heaters, and as shown in FIG. 11, it illustrates the corresponding relationship between the strobe time and the binary data of the points of various grayscale levels when n=8. The print head heaters preheat after receiving the preheat signal and preheat quickly upon receiving a predetermined binary data, thereby improving the printing speed.

According to the principle of the embodiments of the present invention, different grayscale levels can be represented by assigning different values to n, for example, suppose n=7, the corresponding highest grayscale level is level 128, and suppose n=9, the corresponding highest grayscale level is 512, and etc. The principle of realizing the grayscale printing control method is the same with n=8, and thus is omitted herein.

Compared with the prior art, the present invention has a feature that only n strobes need to be conducted for the print head, the data needs to be transmitted n times, and the printing of the grayscale level of the $2^n$ levels can be realized by combination of n segments of different levels of strobe time. Under the precondition of ensuring the printing quality, the times of the printing strobes and the times of the data transmission are reduced, and the printing speed is greatly improved.

Figure 12:
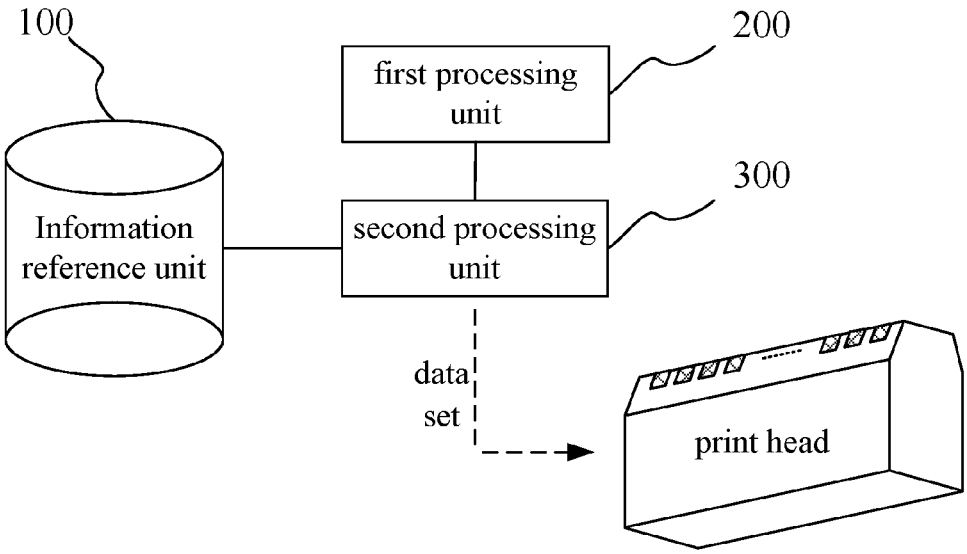
FIG. 12 is a schematic view of the structure of the embodiment of a device that can realize the above grayscale printing control method.

FIG. 12 is a block diagram of a device that can realize some disclosed embodiments (such as the above described). For the convenience of description, herein the device is referred to as a grayscale printing control device.

The grayscale printing control device includes: an information reference unit 100, a first processing unit 200 and a second processing unit 300.

Wherein, the information reference unit 100 stores the corresponding relationship between the grayscale levels and the strobe periods in the printing period of a point line. The grayscale levels are divided into reference grayscale levels and non-reference grayscale levels, and the strobe time corresponding to the non-reference grayscale levels is formed by combination of the strobe time corresponding to the reference grayscale levels.

The first processing unit 200 is configured to acquire the grayscale level of the grayscale image data of each point in each point line and convert the same into multi-bit binary data.

The second processing unit 300 is configured to form a data set using the binary data of the same bit of all the points in a point line, thereby forming multiple data sets, and transmits the data sets to the print head heaters within corresponding strobe periods.

Please refer to the description of the above method for the specific contents of the grayscale levels, the strobe time and the binary data.

Figure 13:
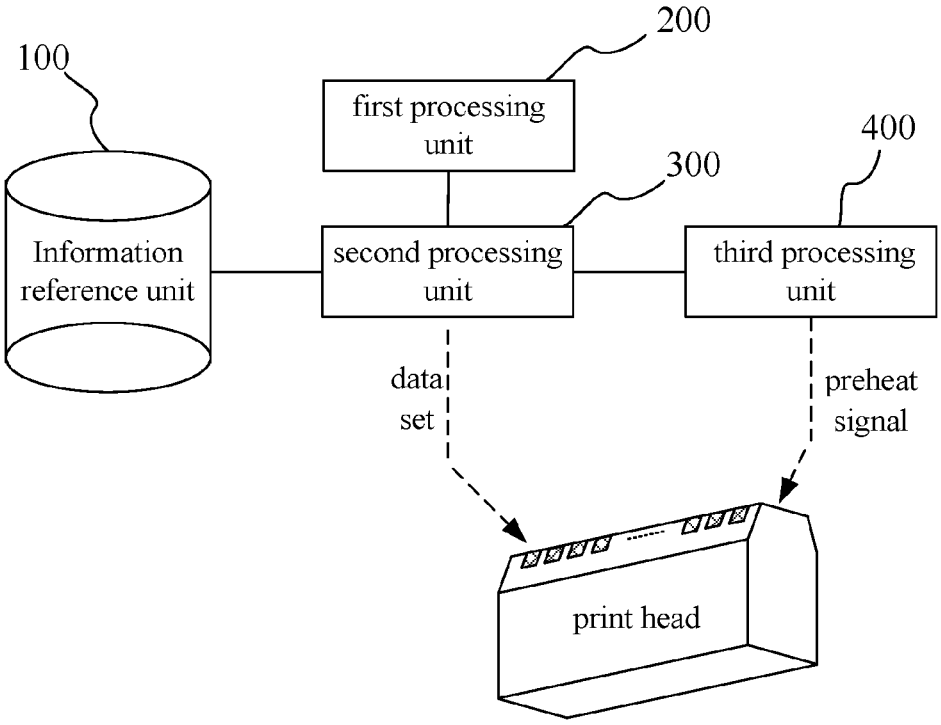
FIG. 13 is a schematic view of the structure of the embodiment of a device that can realize the above grayscale printing control method.

As the heating of the print head heaters takes a certain period of time, to further accelerate the printing speed, before transmitting the data sets to the print head heaters, a preheat signal can be sent to all the print head heaters. To realize the above function, a functional unit can be provided for realizing the function, and referring to FIG. 13, it is a schematic view of a device of some disclosed embodiments.

This functional unit is a third processing unit 400 configured to send the preheat signal to the print head heaters before transmitting the data sets to the print head heaters and instruct the print head heaters to preheat.

The grayscale printing control device according to the present invention can be used in a printing device, and the printing device comprises all the components of current printing devices, such as the print head and other components, and the print head is provided with multiple heaters.

The grayscale printing control device works in cooperation with the print head, and point images of different grayscale levels are printed according to the grayscale image data within the range of a point line where a consumable is in close contact with the print head. The specific process has been detailed in the preceding text and thus is just briefed as follows:

The grayscale printing control device acquires the grayscale level of the grayscale image data of each point in each point line and converts the same into multi-bit binary data, then the binary data of the same bits of all the points in a point line is formed to be a data set, thereby forming multiple data sets, and the data sets are transmitted to the print head within corresponding strobe periods. After receiving the data sets, the print head transmits the data in the data set to corresponding heaters, and the heaters will heat when the data they receive is predetermined data, otherwise, not heat.

The predetermined data can be binary data 1 or 0.

The above printing device can be used in current printers (such as a thermal printer or a thermal transfer printer) to quickly print point images of various grayscale levels.

One skilled in the art should be able to be aware that the illustrative units and algorithm steps described in conjunction with the embodiments disclosed in the present invention can be realized by an electronic hardware, a computer software or the combination of the two, and to clearly describe the interchangeability of the hardware and the software, the constitutions and steps of the embodiments have been generally described according to the functions in the preceding text. Whether such functions are to be executed by hardware or software depends on the specific applications of the technical solution and the constraints of the design. Professional technical staff may use different methods to realize the described functions for each specific application, while such an application shall not be deemed to go beyond the scope of the present invention.

The steps of the method or the algorithm described in conjunction with the embodiments disclosed in the present invention can be realized by hardware, a processor-executed software module, or the combination of the two. The software can be provided in an RAM, a memory, an ROM, an electrically programmable ROM, an electrically erasable programmable ROM, a register, a hard disk, a movable disc, a CD-ROM, or any other form of storage mediums known in the art.

The above description of the disclosed embodiments enables one skilled in the art to realize or use the present invention. Modifications to the embodiments would be obvious for one skilled in the art, and the general principles defined in the present invention can be embodied in other embodiments without departing from the spirit or scope of the present invention. Therefore, the present invention will not be limited to the embodiments illustrated in the above text and shall include the broadest scope consistent with the principles and the novel features disclosed herein.

What is claimed is:

1. A grayscale printing control method, characterized by, comprising:

determining the grayscale level of image data of each point in each point line and converting the same into multi-bit binary data;

forming a data set using the binary data of the same bit of all the points in a point line, thereby forming multiple data sets; and each data set corresponding to a predetermined strobe time, and a print head heater corresponding to each point heating upon receiving predetermined data during the strobe time.

2. The method according to claim 1, characterized in that the predetermination of the strobe time is realized in the following manner:

setting multiple reference grayscale levels, each of which corresponds to a strobe time with a set length; and in a printing period of one point line, setting the number of strobes which is the same as the number of the reference grayscale levels, the duration of each strobe corresponding to the strobe time needed by one reference grayscale level.

3. The method according to claim 2, characterized by, further comprising:

transmitting a preheat signal to the print head heater to instruct the print head heater to preheat before printing.

4. The method according to claim 3, characterized in that there are $2^n$ levels of the grayscale levels in total, and the number of the reference grayscale levels is set to be n, and the number of the predetermined strobes is n.

5. The method according to claim 2, characterized in that there are $2^n$ levels of the grayscale levels in total, and the number of the reference grayscale levels is set to be n, and the number of the strobes is n.

6. The method according to claim 5, characterized in that the predetermined data is 1 or 0.

7. A grayscale printing control device, characterized by, comprising:

a first processing unit, configured to convert the grayscale level of grayscale image data of each point in each point line into multi-bit binary data;

a second processing unit, configured to form a data set using the binary data of the same bit of all the points in a point line, thereby forming multiple data sets;

an information reference unit, which stores the corresponding relationship between the data sets and strobe time; and a transmitting unit, which refers to the corresponding relationship and transmits the data sets to a print head within a corresponding strobe time, so that during the strobe time a print head heater corresponding to respective point heats upon receiving predetermined data.

8. The control device according to claim 7, characterized by, further comprising:

a third processing unit configured to transmit a preheat signal to the print head heater to instruct the print head heater to preheat before printing.

9. The control device according to claim 8, characterized in that the grayscale levels include multiple reference grayscale levels which correspond to the strobe periods of the strobes in the printing period of a point line.

10. The control device according to claim 7, characterized in that the grayscale levels include multiple reference grayscale levels which correspond to the strobe periods of the strobes in the printing period of a point line.

11. The control device according to claim 10, characterized in that there are $2^n$ levels of the grayscale levels in total, and the number of the reference grayscale levels is set to be n, and the number of the strobes in the printing period of the point line is n.

12. A computer-readable storage medium, characterized by, including a computer program code executed by a computer unit, so that the computer unit:

determines the grayscale level of image data of each point in each point line and converts the same into multi-bit binary data;

form a data set using the binary data of the same bit of all the points in a point line, thereby forming multiple data sets; and each data set corresponds to a predetermined strobe time, and a print head heater corresponding to the point heats upon receiving predetermined data during the strobe time.

* * * * *